US005947289A

United States Patent [19]

Stridsberg et al.

[11] Patent Number: 5,947,289

[45] Date of Patent: Sep. 7, 1999

[54] PACKAGE FOR STICK-LIKE ARTICLE

[75] Inventors: Thomas Stridsberg, Tokyo; Masashi Watanabe, Kanagawa; Norio Kobayashi, Tokyo, all of Japan

[73] Assignee: Tetra Laval Holdings & Finance, S.A., Switzerland

[21] Appl. No.: 09/115,909

[22] Filed: Jul. 15, 1998

Related U.S. Application Data

[62] Division of application No. 08/693,280, May 15, 1998, Pat. No. 5,785,177.

[30] Foreign Application Priority Data

Mar. 4, 1994 [JP] Japan ..... 6-34788

[51] Int. Cl.[6] ..... B65D 75/00

[52] U.S. Cl. ..... 206/446; 206/467; 206/471

[58] Field of Search ..... 206/443, 446, 206/216, 217, 541, 542, 461, 467, 468, 469, 470, 471

[56] References Cited

U.S. PATENT DOCUMENTS 3,966,045 6/1976 Perdue ..... 206/471

5,251,758 10/1993 Kolacek ..... 206/471

*Primary Examiner*—Jacob K. Ackun

*Attorney, Agent, or Firm*—Lorusso & Loud

[57] ABSTRACT

A package for a stick-like article includes a first film having flat portions (14*b*) and a bulging portion (14*a*) for enclosing a stick-like article, and a second film which is joined to the first film by heat sealing. Joint portions (33, 34) are formed near both longitudinal ends. Since the package is separated from a packaging container (11) except for areas near both longitudinal ends, fingers can be easily inserted between the package for a stick-like article and the packaging container (11). This makes it easy to remove the package for a stick-like article from the packaging container (11). Since the width of the flat portions (14*b*) at the lateral edges of the package for a stick-like article can be made narrower, the width of the package becomes narrower. Accordingly, the consumption of the first and second films can be reduced. When perforations (36, 37) are formed at locations which are offset from the joint portions (33, 34) toward the center of the package, the perforations (36, 37) act as breaking lines. Accordingly, the package for a stick-like article can be easily removed from the packaging container (11).

2 Claims, 9 Drawing Sheets

PACKAGE FOR STICK-LIKE ARTICLE

CROSS REFERENCE TO RELATED APPLICATION

This application is a division of U.S. Ser. No. 08/693,280, filed May 15, 1998, now U.S. Pat. No. 5,785,177.

TECHNICAL FIELD

The present invention relates to a package for a stick-like article.

BACKGROUND ART

Conventionally, liquid foods such as milk and soft drinks are contained and sold in a packaging container made of a packaging material which is fabricated by coating the inner and outer surfaces of a paper substrate with a polyethylene resin or the like.

Examples of such a packaging container include a gable-top type packaging container having a sloped top, and a brick-type packaging container having a flat top. Liquid food contained in a packaging container which has a small capacity such that a purchaser can consume the food at one time is generally sold at a store or by an automatic vending machine, and is frequently consumed at the place where the food is purchased. Accordingly, a film package containing a straw is usually adhered to each packaging container for sale.

Also, in the sale of semi-hard foods such as yogurt and frozen deserts contained in packaging containers, a film package containing a spoon made of a resin is usually adhered to each packaging container.

FIG. 1 is a perspective view of a conventional packaging container, and FIG. 2 is a perspective view of a conventional straw package.

As shown in these drawings, a package for a stick-like article, for example, a straw package 55 is adhered to a side surface of a packaging container 11. A purchaser of a food placed in the packaging container 11 removes the straw package 55 from the packaging container 11, and takes out a straw 56 from the straw package 55. The straw package 55 is composed of a first film 14 and a second film 13 which are joined together at their peripheral edges by heat sealing. The first film 14 has a bulging portion 14*a* and flat portions 14*b*. The second film 13 is joined to the first film 14 by heat sealing to enclose the straw 56 in the bulging portion 14*a* in a sealed manner.

A plurality of straw packages 55 are first manufactured as an unillustrated straw ladder. Each straw package 55 cut away from the straw ladder is pressed against the packaging container 11 and is adhered thereto by heat fusion. Numeral 57 denotes joint portions at which the straw package 55 is adhered to the packaging container 11.

Next, a conventional straw applicator will be described.

FIG. 3 is an enlarged view showing a heat-fusing section of a conventional straw applicator.

In FIG. 3, numeral 55 denotes a straw package which has been cut from an unillustrated straw ladder, and numeral 56 denotes a straw enclosed in the straw package 55. Numeral 61 denotes a heating section while numeral 62*a* denotes a depression which is formed in the forward end (the left-hand end in FIG. 3) of the heating section 61 at its center so as to allow a bulging portion 14*a* to enter there.

The heating section 61 holds the straw package 55 while receiving the bulging portion 14*a* in the depression 62*a*, and adheres the straw package 55 to the packaging container 11 (FIG. 1). To this end, two pairs of heaters 63 are provided at positions corresponding to the flat portions 14*b* (one pair of heaters is shown in FIG. 3).

The conventional package for a stick-like article, however, has the drawback that it is difficult to insert the fingers between the straw package 55 and the packaging container 11, because the straw package 55 is affixed to the packaging container 11 by pressing the flat portions 14*b* against the packaging container 11 using the two pairs of heaters63. This makes it difficult to remove the straw package 55 from the packaging container 11.

In addition, when the straw package 55 is adhered to the packaging container 11, in order to prevent the straw 56 from deforming or chemically transforming due to heat, the width of the flat portions 14*b* must be large enough to prevent the heat of the heaters 63 from reaching the straw 56. Therefore, the width of the straw package 55 becomes large, resulting in an increase in the consumption of the first and second films 14 and 13, and increasing costs.

Similar problems occur when an unillustrated spoon package is adhered to the packaging container 11 in the above-described manner. That is, it becomes difficult to remove the spoon package from the packaging container 11. Also, since the width of the spoon package becomes large, the amount of film required increases, leading to an increase in costs.

An object of the present invention is to solve the above-described problems of conventional packages for stick-like articles, and to provide a package for a stick-like article which is easily removed from a packaging container, which requires a reduced amount of film, and which reduces costs.

DISCLOSURE OF THE INVENTION

To achieve the objects, a package for a stick-like article according to the present invention includes a first film formed with flat portions and a bulging portion for enclosing a stick-like article, and a second film which is joined to the first film by heat sealing.

Joint portions are formed near both longitudinal ends of the package.

In this case, the first and second films are joined to the packaging container only through the joint portions. Accordingly, the package for a stick-like article is separated from the packaging container except for areas near both longitudinal ends, which allows a purchaser to insert his or her fingers between the package for a stick-like article and the packaging container. This makes it easy to remove the package for a stick-like article from the packaging container.

Moreover, since the joint portions are formed near both longitudinal ends of the package for a stick-like article, the width of the flat portions of the package located at the lateral edges can be made narrower. Accordingly, the width of the package becomes narrower, which reduces the consumption of the first and second films, leading to a reduction in costs.

In another package for a stick-like article according to the present invention, perforations are formed at locations which are offset from the joint portions toward the center of the package and which are slightly offset from the boundaries between the bulging portion and the flat portions toward the longitudinal ends of the package.

In this case, the perforations act as breaking lines when the package for a stick-like article is removed from the packaging container. Accordingly, the package for a stick-like article can be easily removed from the packaging container.

In still another package for a stick-like article according to the present invention, the second film is joined to the packaging container at the joint portions by heat fusion. In this case, a heater is pressed against the joint portions.

In still another package for a stick-like article according to the present invention, the second film is joined to the packaging container at the joint portions using an adhesive material. For example, hot melt is sprayed on the packaging container, and the package for a stick-like article is pressed against the packaging container via the hot melt.

Still another package for a stick-like article according to the present invention includes a first film formed with flat portions and a bulging portion for enclosing a stick-like article, and a second film which is joined to the first film by heat sealing.

The second film contains, as a base resin, an ethylene-vinyl acetate copolymer having a melting point and a vicat softening point both higher than those of the hot melt.

Accordingly, even though the surface of the packaging container and the first film are made of resins having different melting points, the resin forming the surface of the packaging container and the resin of the second film, which are present at the joint portions, are melted and joined together when a heater is pressed against the joint portions. As a result, the straw package can be securely adhered to the packaging container.

Also, the second film does not present stickiness at an ordinary temperature. Moreover, even when a ladder of a plurality of packages for a stick-like article is rolled up, the ladder does not adhere to each other.

Since the ethylene-vinyl acetate copolymer is used only for the second film, the consumption of the ethylene-vinyl acetate copolymer can be reduced, leading to reduced costs.

Even when the packaging container is stored in an automatic vending machine at a temperature of 50° C. or higher, or at a temperature of 10° C. or lower, the package for a stick-like article does not peel off from the packaging container.

Still another package for a stick-like article according to the present invention includes a first film formed with flat portions and a bulging portion for enclosing a stick-like article, a second film which is joined to the first film by heat sealing, and an adhesive film which covers the second film to form joint portions.

In this case, the package for a stick-like article is adhered to the packaging container by heat fusion at joint portions formed near both longitudinal ends of the package. Since the second film is joined to the packaging container by heat fusion only through the joint portions, the package for a stick-like article is separated from the packaging container except for areas near both longitudinal ends, which allows a purchaser to insert his or her fingers between the package for a stick-like article and the packaging container. This makes it easy to remove the package for a stick-like article from the packaging container.

The adhesive film contains, as a base resin, an ethylene-vinyl acetate copolymer having a melting point and a vicat softening point both higher than those of the hot melt.

Accordingly, even though the surface of the packaging container and the second film are made of resins having different melting points, the resin forming the surface of the packaging container and the resin of the adhesive film, which are present at the joint portions, are melted and joined together when a heater is pressed against the joint portions.

As a result, the straw package can be securely adhered to the packaging container.

Also, the adhesive film does not present stickiness at an ordinary temperature. Moreover, even when a ladder of a plurality of packages for a stick-like article is rolled up, the ladder does not adhere to each other.

Since the ethylene-vinyl acetate copolymer is used only for the adhesive film, the consumption of the ethylene-vinyl acetate copolymer can be reduced, leading to reduced costs.

Even when the packaging container is stored in an automatic vending machine at a temperature of 50° C. or higher, or at a temperature of 10° C. or lower, the package for a stick-like article does not peel off from the packaging container.

BEST MODE FOR CARRYING OUT THE INVENTION

Embodiments of the present invention will now be described in detail with reference to the drawings. Although a straw package will be described as an example of a package for a stick-like article, the present invention can be applied to spoon packages.

Figure 1:
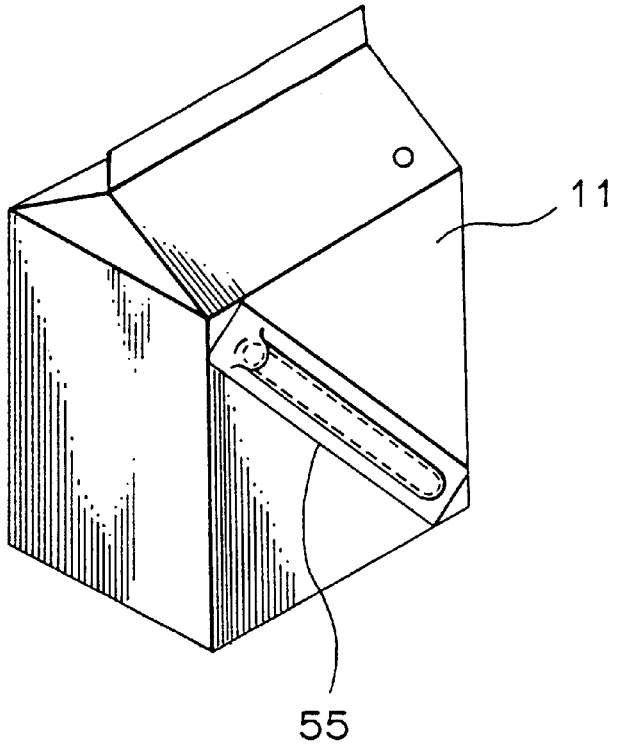
FIG. 1 is a perspective view of a conventional packaging container.
Figure 2:
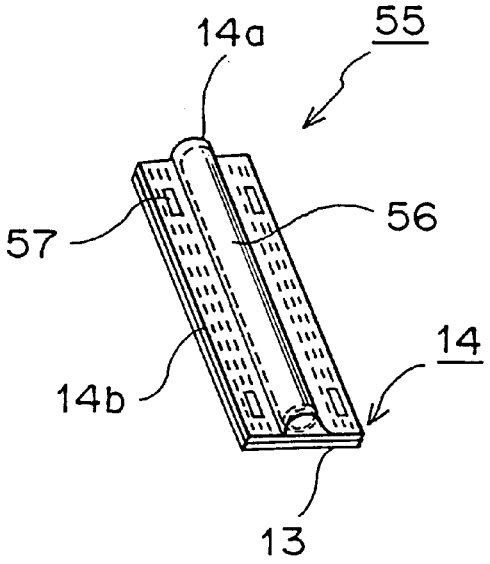
FIG. 2 is a perspective view of a conventional straw package.
Figure 3:
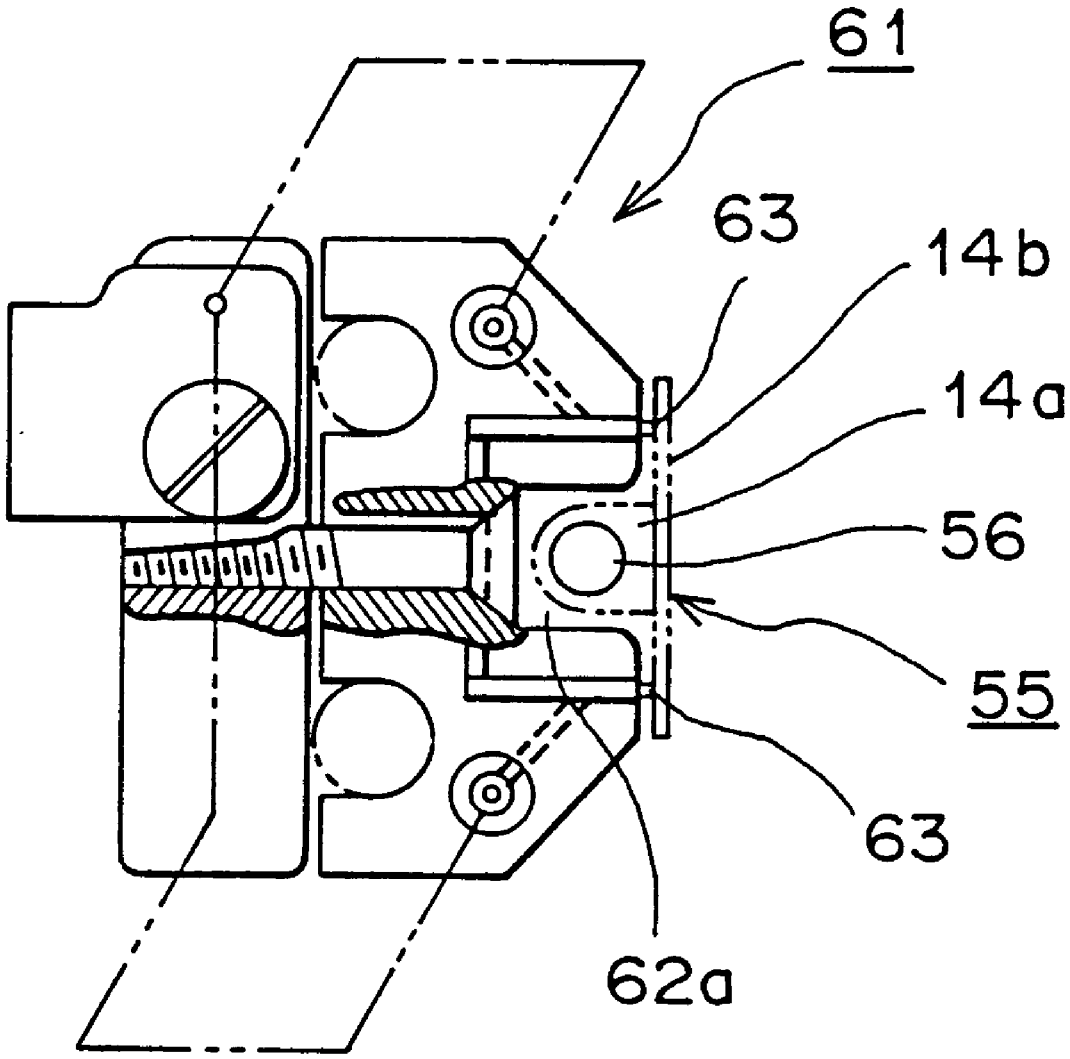
FIG. 3 is an enlarged view of a heat-fusing section of a conventional straw applicator.
Figure 4:
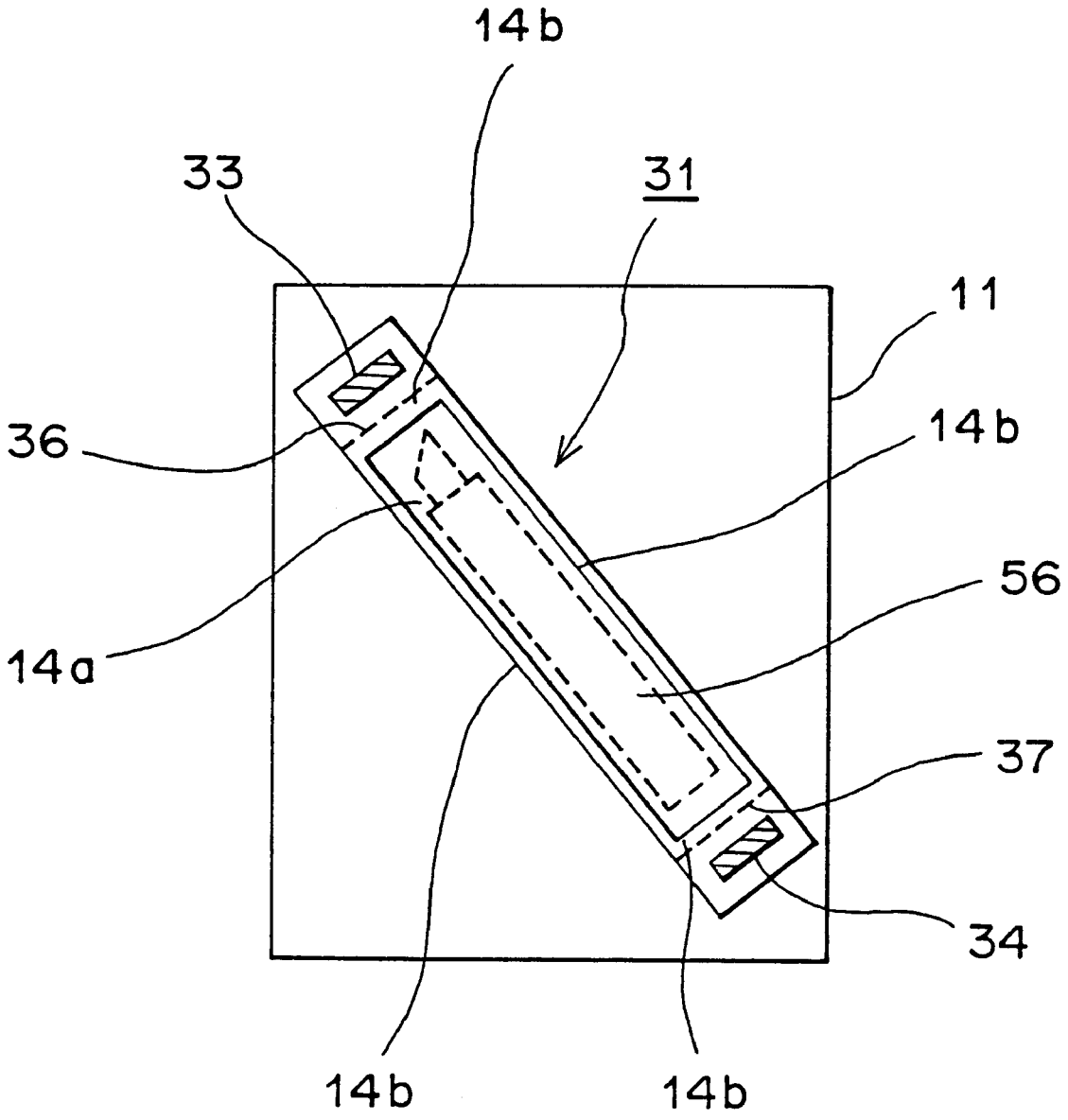
FIG. 4 is a view showing a state in which a straw package according to a first embodiment of the present invention is adhered to a packaging container.
Figure 5:
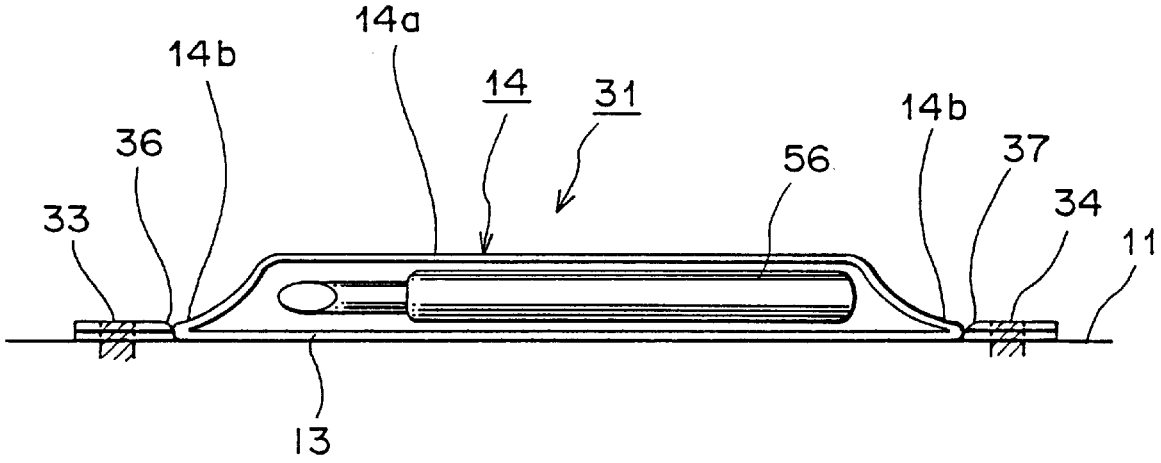
FIG. 5 is a longitudinal cross section of the straw package according to the first embodiment of the present invention.
Figure 6:
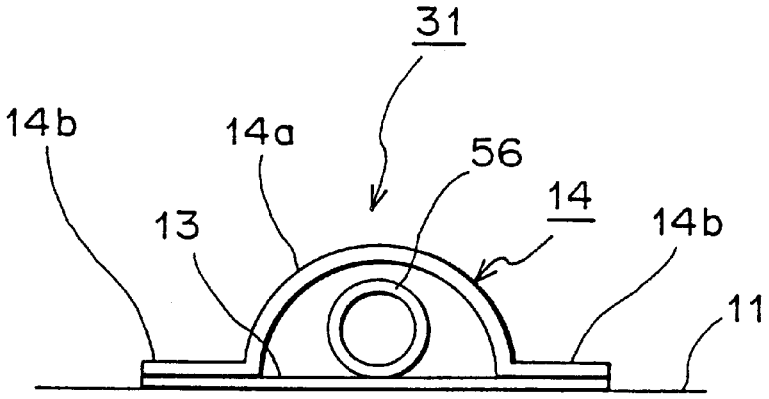
FIG. 6 is a lateral cross section of the straw package according to the first embodiment of the present invention.

FIG. 4 is a view showing a state in which a straw package according to a first embodiment of the present invention is adhered to a packaging container, FIG. 5 is a longitudinal cross section of the straw package according to the first embodiment of the present invention, and FIG. 6 is a lateral cross section of the straw package according to the first embodiment of the present invention.

As shown in these drawings, a straw package 31 is adhered to a side surface of a packaging container 11. To adhere the long straw package 31 within a limited area, the straw package 31 is disposed along a diagonal line of the side surface of the packaging container 11.

The straw package 31 is composed of a first film 14 and a second film 13 which are joined together at their peripheral edges by heat sealing. The first film 14 has a bulging portion 14*a* and flat portions. 14*b*. The second film 13 is joined to the first film 14 by heat sealing to enclose a straw 56 in the bulging portion 14*a* in a sealed manner.

In the present embodiment, a plurality of bulging portions 14*a* are formed at predetermined intervals in the first film 14 having a predetermined width. Straws 56 are placed in the bulging portions 14*a,* and the second film 13 is superposed on the first film 14. The first film 14 and the second film 13 are joined together at the flat portions 14*b* by heat sealing, so that an unillustrated straw ladder is obtained. Subsequently, each straw package 31 is cut from the straw ladder, pressed against the packaging container 11, and joined thereto by heat fusion.

To this end, joint portions 33 and 34 are formed in the flat portions 14*b* provided near both longitudinal ends of the straw package 31. When unillustrated heaters are pressed against the joint portions 33 and 34, the resin forming the joint portions 33 and 34 and the resin coated on the surface of the packaging container are melted and joined together.

In this case, the second film 13 is joined to the packaging container 11 only through the joint portions 33 and 34. Accordingly, as shown in FIG. 5, the straw package 31 is separated from the packaging container 11 except for areas near both longitudinal ends, which allows a purchaser to insert his or her fingers between the straw package 31 and the packaging container 11. This makes it easy to remove the straw package 31 from the packaging container 11.

Moreover, since the joint portions 33 and 34 are formed near both longitudinal ends of the straw package 31, the width of the flat portions 14*b* located at the lateral edges of the straw package 31 can be made narrower. Accordingly, the width of the straw package 31 becomes narrower, which reduces the consumption of the first and second films 14 and 13, leading to a reduction in costs.

Perforations 36 and 37 are formed at locations which are offset from the joint portions 33 and 34 toward the center of the straw package 31 and which are slightly offset from the boundaries between the bulging portion 14*a* and the flat portions 14*b* toward the longitudinal ends of the package 31 such that the perforations 36 and 37 cross the straw package 31 in the lateral direction. The perforations 36 and 37 are formed by unillustrated needle-shaped heaters, while the first film 14 and the second film 13 are heat-sealed together at predetermined intervals. Since the perforations 36 and 37 are formed in the flat portions 14*b* at which the first and second films 14 and 13 have been sealed together by heat, the sealing performance of the straw package 31 does not deteriorate due to the perforations 36 and 37.

The resin composing the first and second films 14 and 13 are melted and joined together, due to heat of the needle-shaped heaters, at the peripheral edge of each hole of the perforations 36 and 37. Accordingly, even when the perforations 36 and 37 are formed at the boundaries between the bulging portion 14*a* and the flat portions 14*b,* the sealing performance of the straw package 31 can be maintained.

As described above, the perforations 36 and 37 are formed at locations which are offset from the joint portions 33 and 34 toward the central portion of the straw package 31, the perforations 36 and 37 act as breaking lines when the straw package 31 is removed from the packaging container 11. Accordingly, the straw package 31 can be easily removed from the packaging container 11.

Also, since the perforations 36 and 37 are formed at the boundaries between the bulging portion 14*a* and the flat portions 14*b,* or at the locations which are slightly offset from the boundaries toward the longitudinal ends of the package, the perforations 36 and 37 can be torn with a weak force after removal of the straw package 31 from the packaging container 11. Accordingly, the straw 56 can be easily taken out of the straw package 31.

The first and second films 14 and 13 are manufactured, for example, by an inflation technique using polyolefin resins such as polyethylene (PE) resins, high density polyethylene (HDPE) resins, low density polyethylene (LDPE) resins, polypropylene (PP) resins, and oriented polypropylene (OPP) resins. When the surface of the packaging container 11 is coated with a resin which is the same as or highly compatible with the resin of the second film 13, the second film 13 can be effectively joined to the packaging container 11 by heat fusion. Accordingly, when the heaters are pressed against the joint portions 33 and 34, the polyolefin resin which is present at the joint portions 33 and 34 and the resin coated on the surface of the packaging container 11 are melted and joined together in order that the straw package 31 is adhered to the packaging container 11. When the oriented polypropylene resin is used, polypropylene resin is extruded to obtain a film, which is then stretched uniaxially or biaxially. In this case, the polypropylene resin becomes transparent because it crystallizes while being formed into a film.

In place of the polyolefin resin, a non-olefin resin may be used for the first and second films 14 and 13.

When the first and second films 14 and 13 are made of polypropylene resin or the like and the surface of the packaging container 11 is coated with polyethylene resin or the like, their compatibility becomes low because their melting points differ considerably from each other. Therefore, it becomes difficult to join the second film 13 to the packaging container 11 by heat fusion. In this case, even if the heaters are pressed against the joint portions 33 and 34, the polypropylene resin which is present at the joint portions 33 and 34 is not joined by fusion to the polyethylene resin coated on the surface of the packaging container 11.

To overcome this problem, when a non-olefin resin, a polypropylene resin, or the like is used for the first and second films 14 and 13, an adhesive material may be disposed at the joint portions 33 and 34 between the second film 13 and the polyethylene resin coated on the surface of the packaging container 11. In this case, the straw package 31 is adhered to the packaging container 11 via the adhesive material. Next, second and third embodiments of the present invention which employ such a structure will be described.

Figure 7:
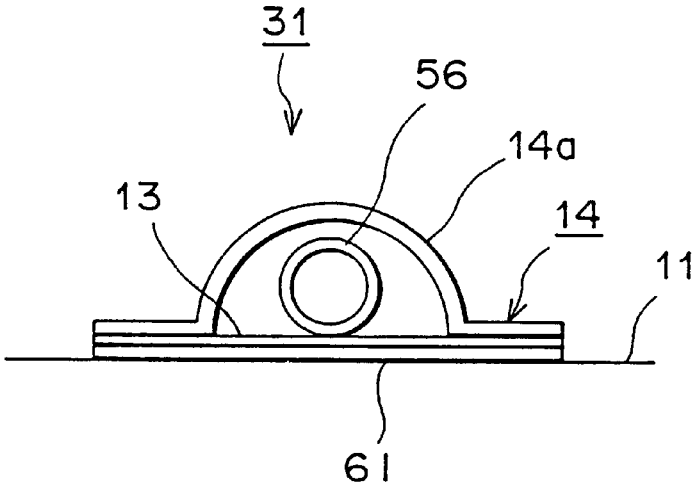
FIG. 7 is a lateral cross section of a straw package according to a second embodiment of the present invention.

FIG. 7 is a lateral cross section of a straw package according to the second embodiment of the present invention.

As shown in FIG. 7, a straw package 31 is composed of a first film 14 and a second film 13, and encloses a straw 56 in a bulging portion 14*a*. A bonding agent 61 serving as an adhesive material is provided between the second film 13 and the packaging container 11. The bonding agent 61 is applied or sprayed with an unillustrated hot-melt gun.

A hot melt which contains an ethylene-vinyl acetate copolymer (EVA) as a base component, can be used as the bonding agent 61. In this case, the hot melt is sprayed from the hot-melt gun against the side wall of the packaging material 11, and the straw package 31 is then pressed against and adhered to the packaging container 11 via the hot melt.

When hot melt is used as the bonding agent 61, an unillustrated heating device is necessary to maintain the hot melt in a molten state.

This increases the size of an unillustrated straw applicator and the energy consumption thereof. Also, since the hot melt is always heated, its properties deteriorate, so that the bonding force decreases, and the nozzle of the hot-melt gun is stuffed.

Also, when the hot melt is sprayed from the hot-melt gun, the hot melt scatters. As a result, the consumption of the hot melt increases, thereby increasing costs. Also, the hot melt cannot be uniformly applied on the surface of the packaging container 11, and so the straw package 31 may peel off from the packaging container 11.

Moreover, when the packaging container 11 is stored in an automatic vending machine at a temperature of 50° C. or higher, the hot melt liquefies. When the packaging container is stored in an automatic vending machine at a temperature of 10° C. or lower, the hot melt solidifies. In both cases, the straw package 31 may peel off from the packaging container 11.

Next, a description is given of the third embodiment which has overcome the above-described problem. In this embodiment, in place of the bonding agent 61, an adhesive film having a melting point and a vicat softening point both higher than those of the hot melt is used as the adhesive material.

Figure 8:
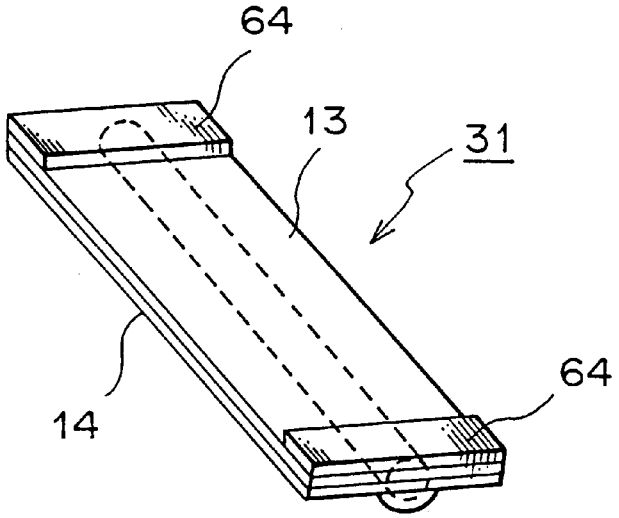
FIG. 8 is a rear elevation of a straw package according to a third embodiment of the present invention.
Figure 9:
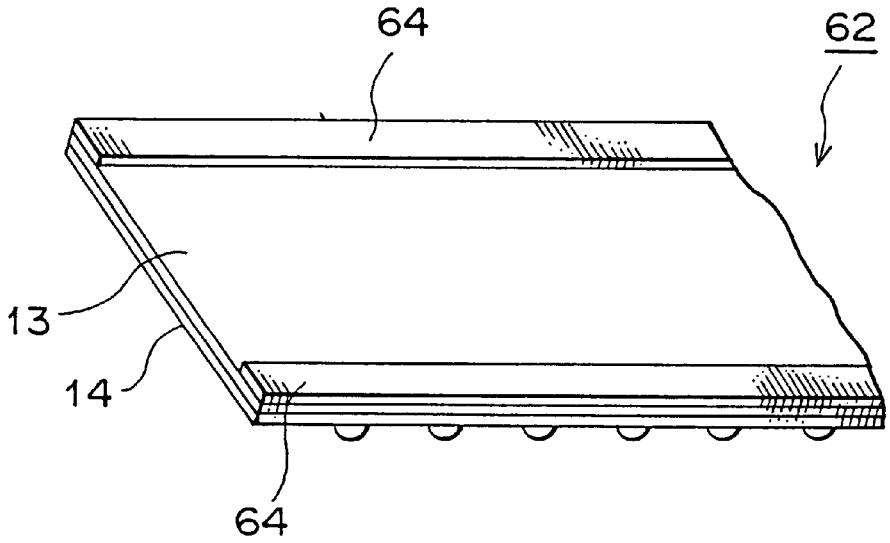
FIG. 9 is a rear elevation of a straw ladder used in the third embodiment of the present invention.
Figure 10:
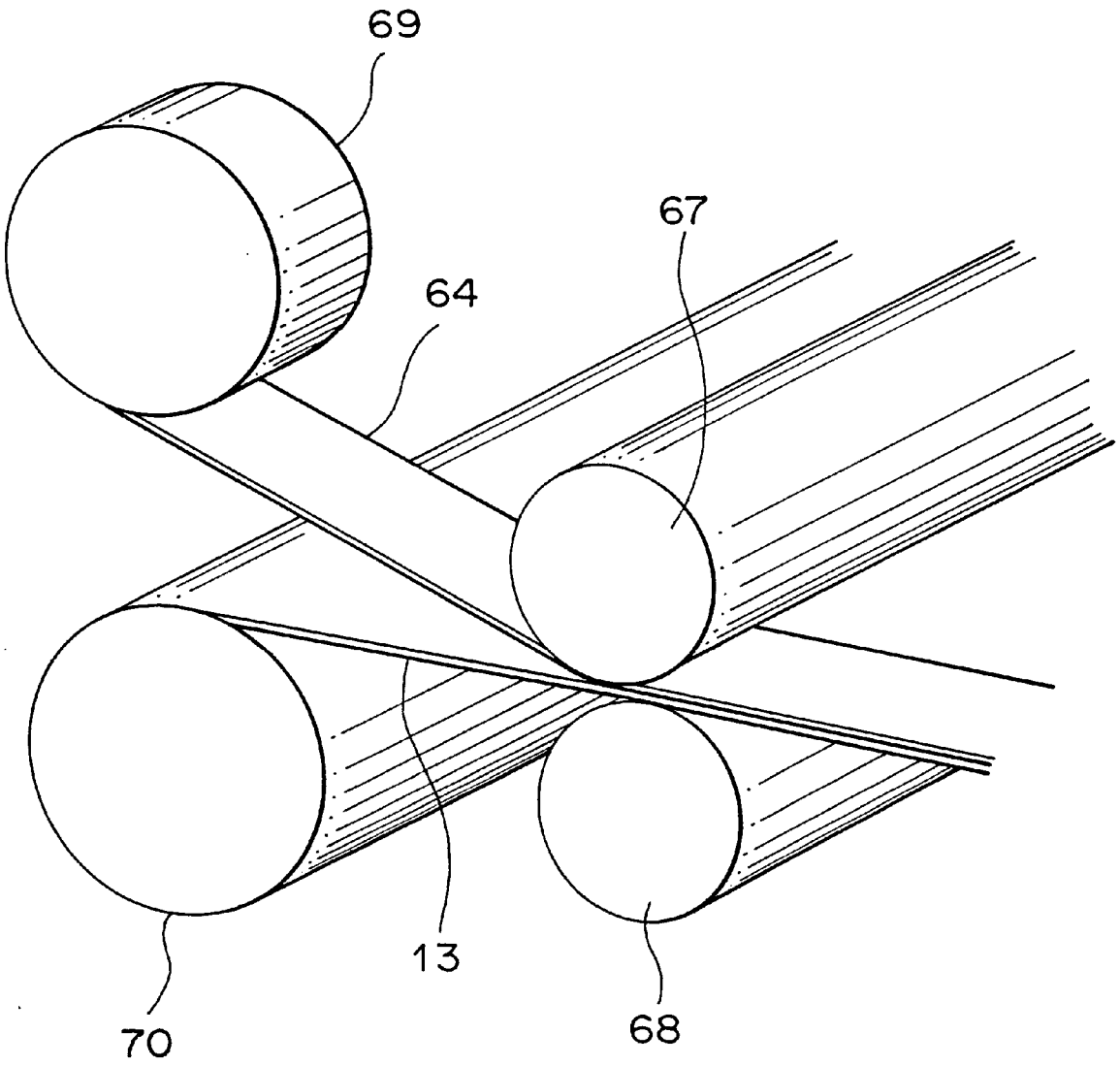
FIG. 10 shows an apparatus for superposing an adhesive film used in the third embodiment of the present invention.
Figure 11:
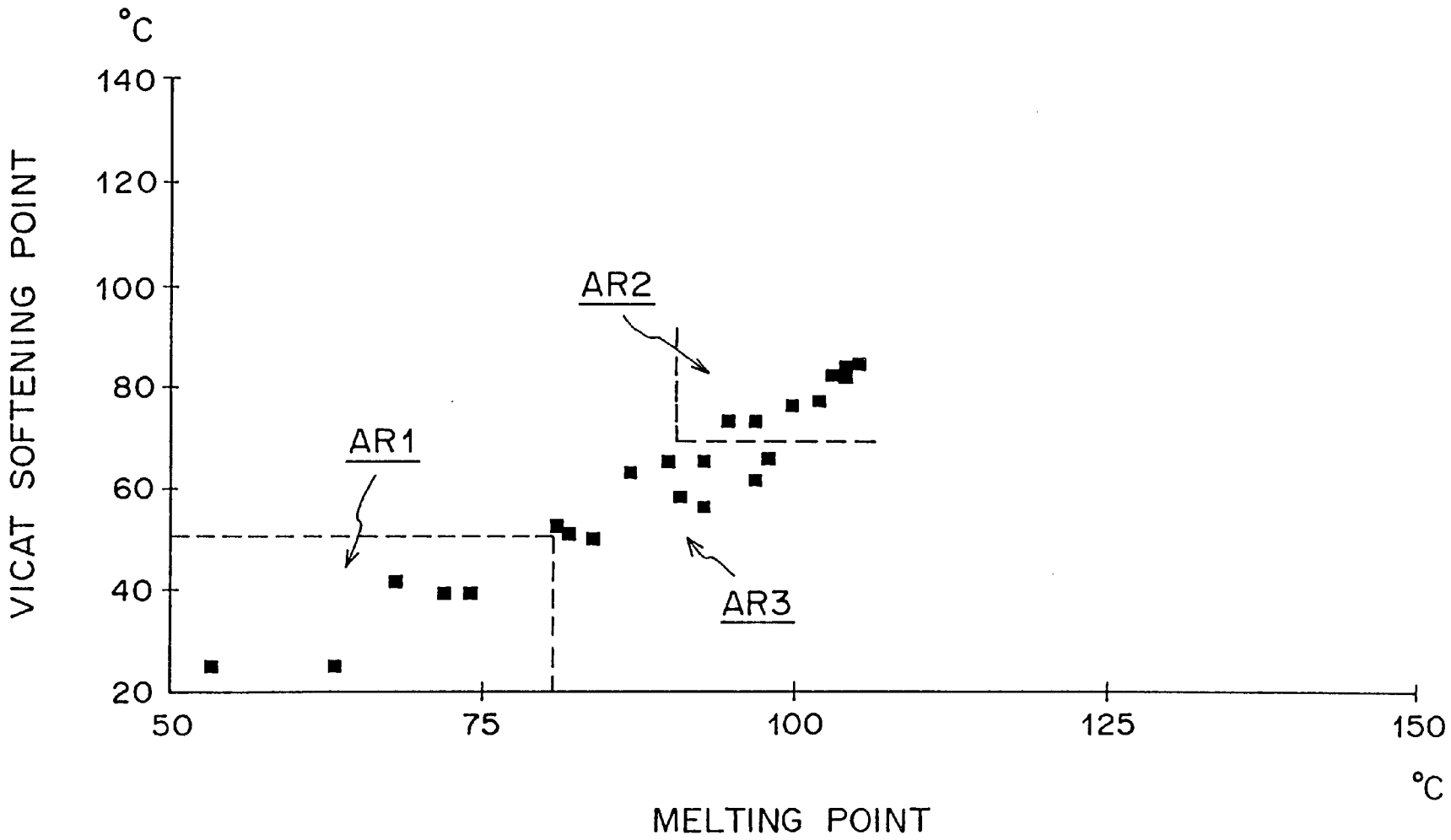
FIG. 11 is a chart showing properties of ethylene-vinyl acetate copolymer used in the third embodiment of the present invention.

FIG. 8 is a rear elevation of a straw package according to the third embodiment of the present invention, FIG. 9 is a rear elevation of a straw ladder used in the third embodiment of the present invention, FIG. 10 shows an apparatus for superposing an adhesive film used in the third embodiment of the present invention, and FIG. 11 is a chart showing properties of ethylene-vinyl acetate copolymer used in the third embodiment of the present invention. In FIG. 11, the abscissa represents the melting point, and the ordinate represents the vicat point.

As shown in FIG. 8, a straw package 31 is composed of a first film 14 and a second film 13, and encloses a straw 56 in a bulging portion 14*a* (FIG. 4). Adhesive films 64 are previously superposed on the second film 13 on the rear surface of the straw package 31 near both longitudinal ends.

In actual cases, the straw package 31 having the above-described structure is formed as a straw ladder 62 shown in FIG. 9. The adhesive films 64 are superposed on the straw ladder 62 at both lateral edges. Each straw package 31 is cut from the straw ladder 62, pressed against the packaging container 11 and adhered thereto by heat fusion.

To this end, joint portions 33 and 34 (FIG. 4) are formed near both longitudinal ends of the first film 14 of the straw package 31, and the unillustrated heaters are pressed against these joint portions 33 and 34. As a result, the adhesive films 64 are melted by heat of the heaters and are joined to the resin coated on the surface of the packaging container 11.

In this case, the adhesive film 64 contains, as a base resin, an ethylene-vinyl acetate copolymer having a melting point and a vicat softening point both higher than those of the hot melt. Accordingly, the adhesive film 64 does not present stickiness at an ordinary temperature even after the adhesive film 64 is superposed on the second film 13. Moreover, even when the straw ladder 62 is rolled up, the straw ladder 62 does not stick to each other.

Since the ethylene-vinyl acetate copolymer is used only for the second film 13, the consumption of the ethylene-vinyl acetate copolymer can be reduced, resulting in reduced costs. Also, since the straw package 31 can be securely adhered to the packaging container 11, the straw package 31 does not peel off from the packaging container 11.

Even when the packaging container is stored in an automatic vending machine at a temperature of 50° C. or higher, or at a temperature of 10° C. or lower, the straw package 31 does not peel off from the packaging container 11.

In the present embodiment, since the second film 13 and the packaging container 11 can be adhered to each other via the adhesive film 64, both polyolefin resins and non-olefin resins can be used for the first and second films 14 and 13.

Although the adhesive film 64 can be superposed on the rear surface of the straw ladder 62 after the straw ladder 62 has been formed, it can be also superposed on the second film 13 in advance.

When the adhesive film 64 is superposed on the second film 13 in advance, the second film 13 and the adhesive film 64 are held and heated by a pair of rollers 67 and 68, as shown in FIG. 10. With this operation, the adhesive film 64 can be superposed on the second film13. The second film 13 is fed from a film roller 70 while the adhesive film 64 is fed from an adhesive film roller 69.

Next, the properties of the adhesive film 64 will be described.

In the present embodiment, an ethylene-vinyl acetate copolymer having the properties shown in Table 1 was used as a base resin of the adhesive film 64.

TABLE 1

| | | |
|---|---|---|
| MFR | 0.5–10 | (dg/min) |
| Density | 0.92–0.94 | (g/cm$^3$) |
| Content of vinyl acetate | –10 | (wt. %) |
| Melting point | 90–105 | (° C.) |
| Vicat softening point | 70–85 | (° C.) |

In Table 1, MFR is an extrusion velocity measured in accordance with JIS K 7210 "Method of testing the flow of thermoplastics".

A film having the properties shown in Table 2 was used for the adhesive film 64.

TABLE 2

| | | |
|---|---|---|
| Thickness of film | 25–150 ($\mu$) | (JIS Z1702) |
| Tensile strength | L: 220–250 (kg/cm$^2$)<br>W: 140–200 (kg/cm$^2$) | (JIS Z1702) |
| Elongation | L: 220–320 (%)<br>W: 450–570 (%) | (JIS Z1702) |
| Tearing strength | L: 40–N.B. (kg/cm)<br>W: 25–N.B. (kg/cm) | (JIS P8116) |
| Haze | 8–14 (%) | (ASTM D1003) |
| Glossiness | 80–100 | (slant: 60° JIS K 7105) |
| Static friction | 0.17–0.70 | (tan θ, ASTM D1894, modified) |
| Impact strength | 1600–2800 (kgcm) | (JIS P8134, modified) |
| Elasticity | L: 900–1700 (kg/cm$^2$)<br>W: 1200–2500 (kg/cm$^2$) | (ASTM D882) |

L: longitudinal direction
W: widthwise direction
N.B.: samples did not break

When melting points and vicat softening points of various kinds of ethylene-vinyl acetate copolymers were plotted, the results obtained are shown in FIG. 11. The vicat softening point is an index for heat resistance.

Ethylene-vinyl acetate copolymers in the area AR1 of FIG. 11 are generally used for hot melt. That is, an ethylene-vinyl acetate copolymer which has an MFR greater than 10 dg/min., which contains vinyl acetate in an amount not less than 25 wt. % and which has a melting point of 80° C. or lower and a vicat softening point of 50° C. or lower is used for hot melt.

In contrast, ethylene-vinyl acetate copolymers in the area AR2 of FIG. 11 are most preferably used for the adhesive film 64 according to the present embodiment, as having been described with reference to Table 1. That is, an ethylene-vinyl acetate copolymer which has an MFR of 0.5–10 dg/min (=g/10 min.), which contains vinyl acetate in an amount not greater than 10 wt. % and which has a melting point of 90–105° C. and a vicat softening point of 70–85° C. is used for the adhesive film 64.

Also, ethylene-vinyl acetate copolymers in the area AR3 of FIG. 11 may be used for the adhesive film 64.

In the present embodiment, the adhesive film 64 contains ethylene-vinyl acetate copolymer as a base resin. However, in place of ethylene-vinyl acetate copolymer, polyolefin resins or copolymers of polyolefin resins may be used as a base resin.

Next, a fourth embodiment of the present invention will be described.

Figure 12:
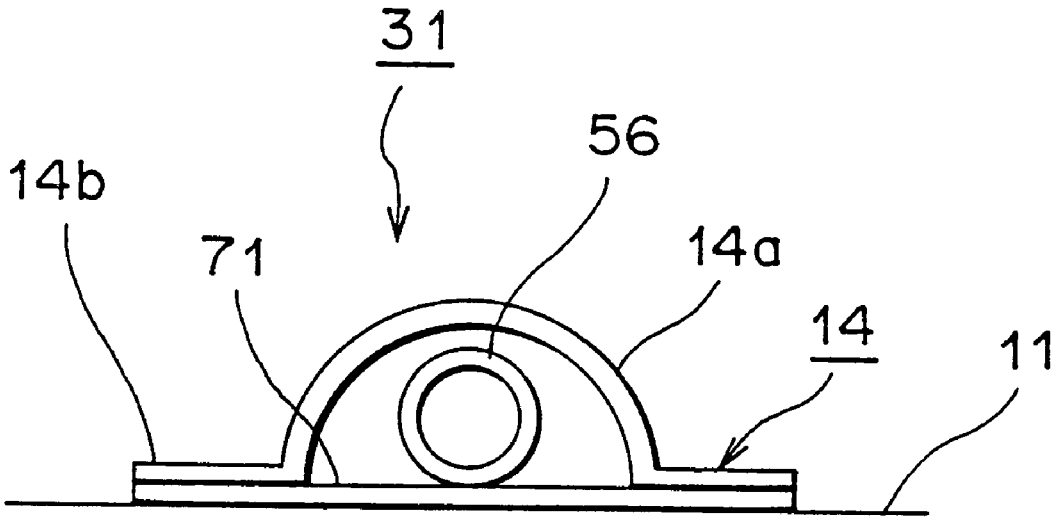
FIG. 12 is a lateral cross section of a straw package according to a fourth embodiment of the present invention.

FIG. 12 is a lateral cross section of a straw package according to the fourth embodiment of the present invention.

As shown in FIG. 12, a straw package 31 is composed of a first film 14 and an adhesive film 71 serving as a second film, and encloses a straw 56 in a bulging portion 14*a*. The adhesive film 71 entirely covers the rear surface of the straw package 31.

A plurality of straw packages 31 are formed as an unillustrated straw ladder. Each straw package 31 is cut from the straw ladder, pressed against the packaging container 11 and adhered thereto by heat fusion.

To this end, joint portions 33 and 34 (FIG. 4) are formed in the flat portions 14*b* near both longitudinal ends of the straw package 31. When the unillustrated heaters are pressed against the joint portions 33 and 34, the resin of the adhesive film 71 is melted at the joint portions 33 and 34 and are joined to the resin coated on the surface of the packaging container 11.

The present invention is not limited to the above-described embodiments. Numerous modifications and variations of the present invention are possible in light of the spirit of the present invention, and they are not excluded from the scope of the present invention.

INDUSTRIAL APPLICATION

The present invention can be applied to straw packages, each including a straw in a film, and spoon packages, each including a spoon in a film.

We claim:

1. A package for a stick-like article, comprising:

(a) a first film formed with flat portions at opposing edges thereof and a bulging portion, extending longitudinally between said flat portions, for enclosing a stick-like article;

(b) a second film which is joined to said first film by heat sealing between said flat portions and said second film; and (c) an adhesive film which covers at least a portion of said second film to form joint portions adjacent said opposing edges, in which (d) said adhesive film contains, as a base resin, an ethylene-vinyl acetate copolymer having a melting point and a vicat softening point both higher than those of hot melt.

2. A package for a stick-like article according to claim 1 wherein said adhesive film covers two areas on said second film, opposite said first film and located adjacent said opposing edges, on opposite sides of said bulging portion.

* * * * *